US006818591B2

(12) United States Patent
Arai et al.

(10) Patent No.: US 6,818,591 B2
(45) Date of Patent: Nov. 16, 2004

(54) REVERSIBLE THERMOSENSITIVE RECORDING MEDIUM, LABEL, AND IMAGE FORMING AND ERASING METHOD USING THE SAME

(75) Inventors: Satoshi Arai, Shizuoka (JP); Shin Yamamoto, Shizuoka (JP); Tadafumi Tatewaki, Shizuoka (JP); Yoshihiko Hotta, Mishima (JP); Takashi Kitamura, Ichikawa (JP)

(73) Assignee: Ricoh Company, Ltd., Tokyo (JP)

( * ) Notice: Subject to any disclaimer, the term of this patent is extended or adjusted under 35 U.S.C. 154(b) by 202 days.

(21) Appl. No.: 10/198,166

(22) Filed: Jul. 19, 2002

(65) Prior Publication Data

US 2003/0114304 A1 Jun. 19, 2003

(30) Foreign Application Priority Data

Jul. 19, 2001 (JP) ..... P2001-220363
Jul. 17, 2002 (JP) ..... P2002-208835

(51) Int. Cl.[7] ..... B41M 5/30
(52) U.S. Cl. ..... 503/201; 428/64.4; 503/200
(58) Field of Search ..... 428/64.4; 503/200, 503/201, 226

(56) References Cited

U.S. PATENT DOCUMENTS 5,185,194 A 2/1993 Miyake et al. ..... 428/64
5,489,494 A * 2/1996 Hotta et al. ..... 430/19
5,538,822 A * 7/1996 Hotta et al. ..... 219/216
5,616,262 A * 4/1997 Itoda et al. ..... 235/380
5,635,319 A * 6/1997 Hotta et al. ..... 430/19
5,686,382 A 11/1997 Suzuki et al. ..... 503/201
5,716,477 A * 2/1998 Yamaguchi et al. ..... 430/19
5,747,413 A * 5/1998 Amano et al. ..... 503/201
5,869,422 A 2/1999 Kazumi et al. ..... 503/207
5,880,445 A * 3/1999 Mori et al. ..... 430/19
5,942,377 A * 8/1999 Torii et al. ..... 430/338
5,948,727 A * 9/1999 Hotta et al. ..... 503/200
5,981,115 A * 11/1999 Furuya et al. ..... 430/19
5,981,429 A * 11/1999 Kawamura et al. ..... 503/207
6,015,770 A 1/2000 Amano et al. ..... 503/201
6,090,748 A * 7/2000 Furuya et al. ..... 503/201
6,117,562 A 9/2000 Yamaguchi et al. ..... 428/537
6,154,243 A * 11/2000 Tatewaki et al. ..... 317/223
6,172,001 B1 1/2001 Hotta et al. ..... 503/201
6,261,992 B1 * 7/2001 Furuya et al. ..... 503/201

FOREIGN PATENT DOCUMENTS

EP 0 891 875 1/1999

* cited by examiner

*Primary Examiner*—Bruce H. Hess
(74) *Attorney, Agent, or Firm*—Oblon, Spivak, McClelland, Maier & Neustadt, P.C.

(57) ABSTRACT

A reversible thermosensitive recording medium comprising an concealing layer provided between a reversible thermosensitive recording layer which is reversibly changed in its color by heat and a photo-thermal conversion layer which absorbs light with generating heat, wherein the concealing layer has an optical characteristic that the ratio of a light absorptivity of light having 555 nm wavelength, in comparison with a light absorptivity of laser light wavelength, is 80% or less. This reversible thermosensitive recording medium has a concealing layer to conceal the color of the photo-thermal conversion layer, thereby the visibility and the contrast of the obtained images are significantly improved, further more, durability in repeated used is also significantly improved.

19 Claims, 4 Drawing Sheets

REVERSIBLE THERMOSENSITIVE RECORDING MEDIUM, LABEL, AND IMAGE FORMING AND ERASING METHOD USING THE SAME

BACKGROUND OF THE INVENTION

1. Field of the Invention

The present invention relates to a reversible thermosensitive recording medium capable of forming and erasing a color image, using the reversible thermosensitive coloring composition, by controlling thermal energy to be applied to the recording medium, and to a label and an image forming and erasing method.

2. Description of the Related Art

In recent years, reversible thermosensitive recording mediums have been paid attention in which an image information is temporarily recorded or written and when not needed, erased or eliminated. As a typical example, there is known a characteristic reversible thermosensitive recording medium, in which particles of developer such as an organic phosphoric acid compound, as shown in Patent Publications of Tokkai Hei 5-124360 and Tokkai Hei 6-210954 and so forth publications.

However, such reversible thermosensitive recording media (these reversible thermosensitive recording medium may also be described as simply "recording medium" hereinafter) in conventional art are, especially in case of image forming and erasing procedures are repeated using thermal head, suffered from rubbings by the thermal head accompanied with application of heat, therefore scratches are generated on its surface, and when the scratches have been grown considerably, there is observed a drawback that images can be not formed uniformly. This phenomenon is mainly caused by a large mechanical stress which is imposed to the surface of the recording medium in accompanied with application of heat, therefore the surface of the recording medium is deteriorated, and damages in the surface become serious, thus the durability for repeated uses is decreased. Accordingly, for decreasing the generation of such scratches on the furface of the recording medium, there are previously proposed attempts for providing a protection layer onto the recording medium surface, as disclosed in Japanese Unexamined Patent Publications of Tokkai Hei 10-291371 and Tokkai Hei 10-291372. However, it is very hard to say that the sufficient durability for scratching damages can be attained by providing only a protection layer onto the surface of the recording medium surface.

In order to cope with this problem, there is known a laser recording method that is capable of recording with non-contact mode. In this recording method the mechanical pressure does not apply to the recording layer in the period when it being softened, therefore can be evaded the deterioration of the recording medium. For example Japanese Unexamined Patent Publication of Tokkai Shou 57-82088 discloses a recording method in which carbon black is included in a reversible thermosensitive recording layer or in another layer adjacent to the reversible thermosensitive recording layer of a recording medium, and this recording medium is recorded using laser light. By this recording method, non-contact mode of recording becomes possible, however in this recording method there is a shortcoming that it causes gray tone in whole images, not only in case of that carbon black is included in a reversible thermosensitive recording layer but also in case of that carbon black is included in another layer adjacent to the reversible thermosensitive recording layer of a recording medium, thus this method significantly reduces the contract of the image. And then, Japanese Unexamined Patent Publication of Tokkai Shou 64-14077 discloses a recording method in which, instead of carbon black used in aforementioned method, an infrared ray-absorbing dye is used. By this recording method, the image density is more improved than that of aforementioned method using carbon black, however the infrared ray-absorbing dye has a light absorptive characteristic for visible light wavelength range too, therefore the contrast of image is still low with this recording method.

On the other hand, in case of a reversible thermosensitive recording medium based upon a polymer material using a physical property change that can shift its transparency between clear tone and milky tone, although the contrast of the image in the recording medium is apt to reduce a coloring by the infrared ray-absorptive dye, the visibility itself of the obtained image is not considerably decreased, as shown in a disclosure by Japanese Unexamined Patent Publication of Tokkai Hei 8-118819. By contract to this, a thermosensitive reversible recording medium capable of forming and erasing a color image shows a considerable decrease of contrast which is caused by an infrared ray-absorptive dye incorporated, causing a considerable loss of the visibility. Further the repeated printing and erasing using laser beam results the degradation of the photo-thermal conversion layer, hence decreasing the durability for repeated uses.

SUMMARY OF THE INVENTION

It is hence an object of the present invention, in view of the situation of above descried prior arts, to provide a reversible thermosensitive recording medium having improved characteristics, in which the appeared color in the photo-thermal conversion layer being concealed, thereby contrast and visibility of the image formed are improved, and showing excellent durability for repeated uses. And it is other objects of the present invention to provide an image recording and erasing method, and usage using the reversible thermosensitive recording medium, and beneficial usage of the reversible thermosensitive recording medium.

Above and other objects of the present invention are achieved by a reversible thermosensitive recording medium which comprising:

(1) A reversible thermosensitive recording medium comprising an concealing layer provided between a reversible thermosensitive recording layer which is reversibly changed in its color by heat and a photo-thermal conversion layer which absorbs light with generating heat, wherein the concealing layer has an optical characteristic that the ratio of a light absorptivity of light having 555 nm wavelength, in comparison with a light absorptivity of laser light wavelength, is 80% or less;

(2) A reversible thermosensitive recording medium according to above paragraph (1);

wherein the concealing layer has an optical characteristic that a light absorptivity of light having 555 nm wavelength, is 1.25 or more.

(3) A reversible thermosensitive recording medium according to above paragraph (1);

wherein the concealing layer has an optical characteristic that a light absorptivity of laser light, is 1 or less.

(4) A reversible thermosensitive recording medium according to above paragraph (1);

wherein the optical reflection density at background area of the reversible thermosensitive recording layer is 0.5 or less.

(5) A reversible thermosensitive recording medium according to above paragraph (1);

wherein the concealing layer has a gel fraction ratio of 30% or more.

Above and other objects of the present invention are achieved by a card having a reversible thermosensitive recording medium which comprising:

(6) A card having a reversible thermosensitive recording medium portion and an information memory portion, wherein the reversible thermosensitive recording medium portion is a recording medium according to above paragraph (1);

(7) A card having a reversible thermosensitive recording medium portion and an information memory portion, wherein the reversible thermosensitive recording medium portion is a recording medium according to above paragraph (1), and the information memory portion comprises at least a memory selected from magnetic memory, I C memory or optical memory;

(8) A card having a portion of a reversible thermosensitive recording medium layer, a supporting member and a magnetic recording layer, which are being superimposed in this order, wherein the reversible thermosensitive recording medium portion is a recording medium according to above paragraph (1).

Above and other objects of the present invention are achieved by a label having a reversible thermosensitive recording medium which comprising:

(9) A reversible thermosensitive recording label having a reversible thermosensitive recording medium portion, a supporting member and an adhesive or stickness layer, which are being superimposed in this order, wherein the reversible thermosensitive recording medium portion is a recording medium according to above paragraph (1).

Above and other objects of the present invention are achieved by a disc cartridge having on it a reversible thermosensitive recording label reversible thermosensitive recording medium which comprising:

(10) A disc cartridge having in its inside a disc which is capable of rewriting an information and has a reversible thermosensitive recording label thereon, the reversible thermosensitive recording label has a reversible thermosensitive recording medium, a supporting member and a portion of adhesive or stickness layer, which are being superimposed in this order, wherein the reversible thermosensitive recording medium is a recording medium according to above paragraph (1).

Above and other objects of the present invention are achieved by a disc having on it a reversible thermosensitive recording label reversible thermosensitive recording medium which comprising:

(11) A disc which is capable of rewriting an information or recording an additional information and has a reversible thermosensitive recording label thereon, wherein the reversible thermosensitive recording medium is a recording medium according to above paragraph (1); and,

(12) A disc which is capable of rewriting an information or recording an additional information and has an attached reversible thermosensitive recording label thereon.

wherein the reversible thermosensitive recording label has a reversible thermosensitive recording medium, a supporting member and a portion of adhesive or stickness layer, which are being superimposed in this order, and the reversible thermosensitive recording medium is a recording medium according to above paragraph (1).

Above and other objects of the present invention are achieved by a cassette having a reversible thermosensitive recording label which comprising:

(13) A cassette for recording tape which is capable of rewriting an information and being attached with a reversible thermosensitive recording label, wherein the reversible thermosensitive recording label has a reversible thermosensitive recording medium, a supporting member and a portion of adhesive or stickness layer, which are being superimposed in this order, and the reversible thermosensitive recording medium is a recording medium according to above paragraph (1).

Above and other objects of the present invention are achieved by a reversible thermosensitive recording medium and an image recording, and erasing method and apparatus which comprising:

(14) A reversible thermosensitive recording medium according to above paragraph (1), comprising image which being formed by printing;

(15) An image recording and/or erasing method, wherein a reversible thermosensitive recording medium according to above paragraph (1) is used, and at least either image recording or erasing is conducted by irradiating laser light;

(16) An image recording and/or erasing method, wherein a reversible thermosensitive recording medium according to above paragraph (1) is used, and at least either image recording or erasing is conducted by irradiating, laser light having a wavelength 700 nm or more

(17) An image recording and erasing method, wherein a reversible thermosensitive recording medium according to above paragraph (1) is used, and both image recording and erasing are conducted with adjusting at least any one among applied actions of light irradiation time, amount of light emission, focussing point of irradiated light, or intensity distribution of irradiated light.

The inventors of the present invention have studied for overcoming the foregoing disadvantages and discovered that an improved reversible thermosensitive recording medium can be obtained, in which the contrast of the image is improved by defining the relationship between the light absorptivity of a light having 555 nm wavelength and the light absorptivity of a laser beam light at a concealing layer, and the durability for repeated uses is improved too by defining the gel fraction ratio for the concealing layer.

Namely, there is provided an improved reversible thermosensitive recording medium comprising a concealing layer provided between a reversible thermosensitive recording layer which is reversibly changed in its color by heat and a photo-thermal conversion layer which absorbs light with generating heat, in which formed color of the concealing layer is concealed, contrast and visibility of the image formed in the recording medium are increased, and the durability for repeated uses is improved too, when the characteristic of the concealing layer is defined so that the concealing layer has an optical characteristic what the ratio of a light absorptivity of a light having 555 nm wavelength, in comparison with a light absorptivity of a laser light, is 80% or less, and the concealing layer is defined so that it has an optical characteristics that a light absorptivity of light having 555 nm wavelength, is 1.25 or more, and a light absorptivity of laser beam light, is 1 or less, and optical reflection density at background area of the reversible thermosensitive recording layer is 0.5 or less, the resin included in the concealing layer being cross-linked and the concealing layer has a gel fraction ratio of 30% or more.

These and other objects, features and advantages of the reversible thermosensitive recording medium of the present invention will become apparent upon a consideration of the following description including the preferred embodiments of the invention taken in conjunction with the accompanying drawings.

BRIEF DESCRIPTION IF THE DRAWINGS

Figure 1:
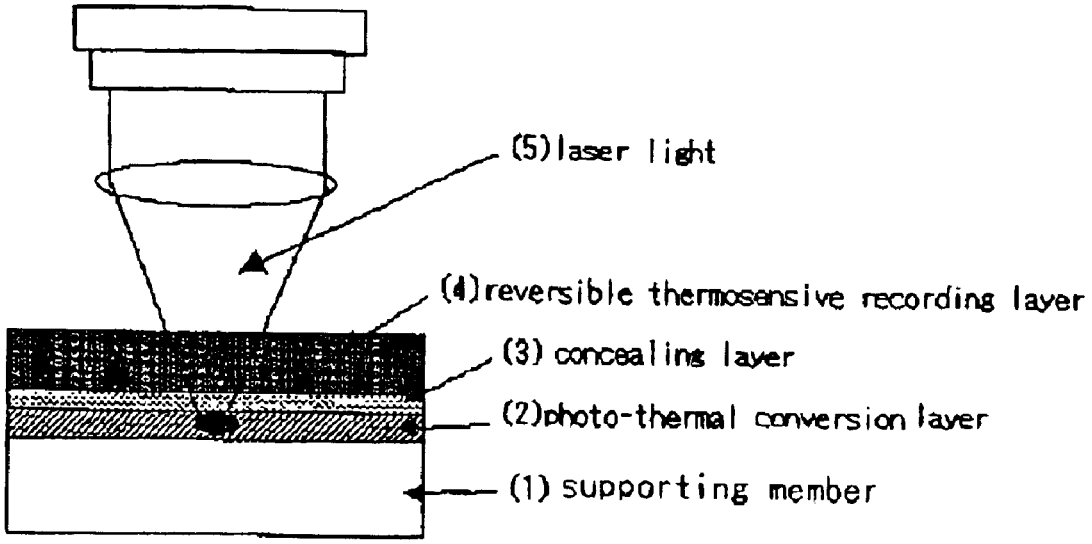
FIG. 1 is a schematic cross-sectional view of the reversible thermosensitive recording medium of the present invention.

The reversible thermosensitive recording medium of the present invention shown in FIG. 1 is constituted by a photo-thermal conversion layer (2), a concealing layer (3) and a recording layer (4) which are being accumulated on a supporting member (1) in this order. In order to record in and erase out the image of this reversible thermosensitive recording medium by using laser beam light (5), a photo-thermal conversion layer (2) for converting the laser light energy to thermal energy is required. The laser light (5) is focussed to the photo-thermal conversion layer (2) to generate the heat, and the generated heat is transferred to the concealing layer (3) then to the recording layer (4), and when the temperature of the recording layer (4) is elevated to the level of coloring temperature, colored images are formed on the recording layer (4). And, by adjusting at least one condition among an irradiation period of the time, an irradiation amount of light, the focal point and the intensity distribution of the light, then erasing temperature which differs from the coloring temperature can attained thus the colored images can be erased. For instance, when the erasing temperature is lower than the coloring temperature, light irradiation is de-focussed from the focal point which being selected at recording procedure, thereby diameter of irradiated beam spot upon the photo-thermal conversion layer is made larger, thus intensity distribution of the light is made gentleness, to turn to the erasing temperature, and the like.

Wave lengths of the laser lights used in the laser recordings are 700 nm or more in many cases, therefore photo-thermal conversion material used in the photo-thermal conversion layer (2) is required to have an absorptivity for the light of such wave length or the light including mainly an ingredient of light having such wave length. And at the same time, it is desired that the photo-thermal conversion material does not have the absorptivity for visible light. However, the photo-thermal conversion material, has the absorptive of visible light, although a small quantity thereof, hence is colored. Thereupon it may be considered that the coloring is suppressed by reducing the content of the photo-thermal conversion material, but a sufficient amount of heat generation can not obtained by this way. And perfect suppression of the coloring can also not attained, because the absorption for any visible light results an inevitable coloring and the resulted color influences to the color tone of the color images on the reversible thermosensitive recording medium, deteriorating the contrast of the images. Accordingly, for the purpose of solving this problem, the present invention has provided a concealing layer having a defined nature between the photo-thermal conversion layer and the recording layer. The concealing layer is provided for the purpose of eliminating the influence of appeared color in the photo-thermal conversion layer, and is required to not pass through the visible light, and on the other hand is required to pass through the laser light to generate heat by the photo-thermal conversion layer.

Consequently, the inventors paid an attention to the relationship between the light absorptivity of a light having 555 nm wavelength, which is the central wavelength of visible light band, and the light absorptivity of a laser light at concealing layer, then found out that the problems were able to solve by defining the characteristic of the concealing layer which is the ratio of a light absorptivity of a light having 555 nm wavelength, in comparison with a light absorptivity of a laser light.

Here, the "concealing layer" is a layer provided between the recording layer and the photo-thermal conversion layer, and it can pass through the laser beam, but it is difficult to pass through the visible light, and it has a role to make invisible the color at the photo-thermal conversion layer, thereby it does not decrease the contract of images being formed in recording layer.

Figure 2:
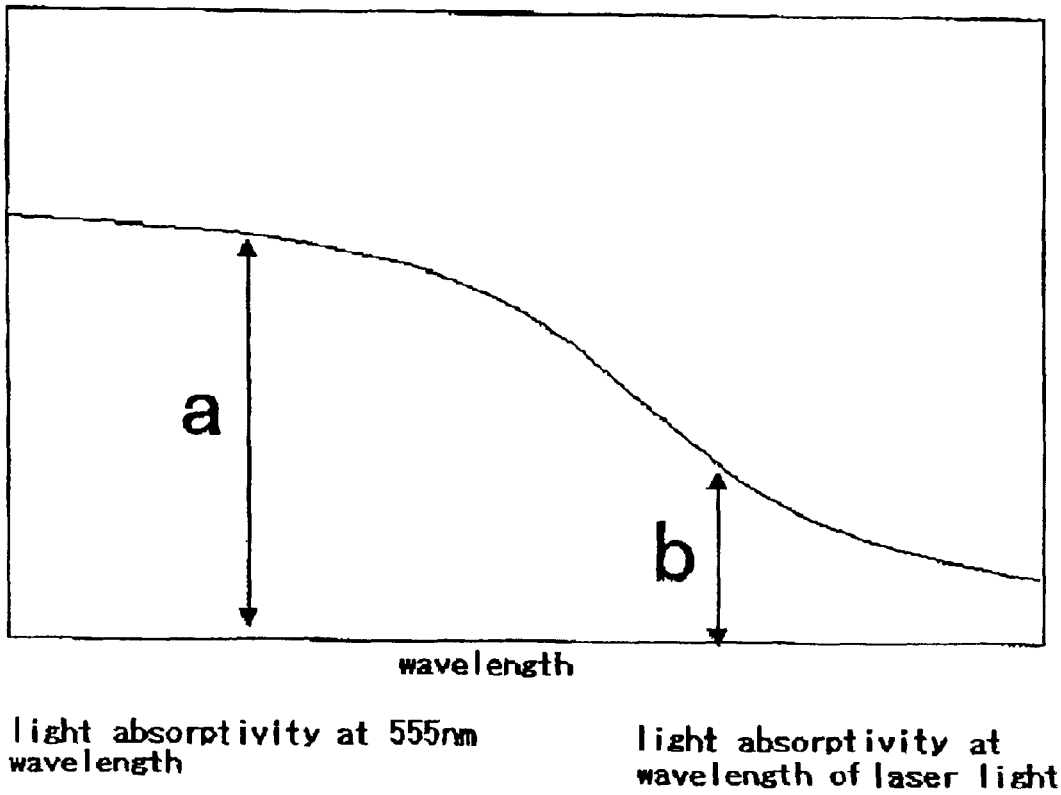
FIG. 2 is a graph showing the relationship between the light absorptivity of a light having 555 nm wavelength and the light absorptivity of a laser light at the concealing layer.

FIG. 2 shows the relationship between the light absorptivity of a light having 555 nm wavelength and the light absorptivity of a laser light in concealing layer. Symbol (a) is absorptivity at 555 nm wavelength and symbol (b) is absorptivity of laser light, here, it is favorable that the absorptivity (a) at 555 nm wavelength is 80% or less than absorptivity (b) of laser light. If the ratio of the absorptivity (a) for the absorptivity (b) exceeds 80%, the laser light irradiated can not pass through sufficiently, hence sufficient amount of laser light required for heat generation does not arrive to the photo-thermal conversion layer, therefore efficiency is significantly deceased, thus sufficiently colored image can not obtained. The ratio of the absorptivity (a) for the absorptivity (b) is favorably 60% or less, more favorably 40% or less, and to gain further large effect, 20% or less is the most favorable. On the other hand, the light absorptivity of a light having 555 nm wavelength at concealing layer is favorably 1.25 or more. The light absorptivity lower than that level is insufficient to conceal the color of the photo-thermal conversion layer, and it favorably is 1.4 or more.

The light absorptivity of laser light at the concealing layer is 1 or less. The light absorptivity higher than that level causes the larger loss in laser light irradiation, resulting reduction of efficiency, thus sufficiently colored image can not obtained. The degree of the light absorptivity of laser light at the concealing layer is favorably 0.8 or less, more favorably 0.5 or less, and especially favorably 0.3 or less.

And it is favorable that a resin contained in the concealing layer which being cross-linked, and the gel fraction ratio is 30% or more. Transformation or corruption in shape of the concealing layer by heating can eliminated or suppressed. The gel fraction ratio less than 30% in the resin causes an insufficient heat-resistance, hence generating a reduction of thermal resistive for repeated uses. The fraction in the resin is favorably 50% or more, and 70% or more is further favorable.

Measurements of the densities in the present invention were conducted using a spectro-photometer (model U-3300 manufactured by Hitachi, Ltd.). Materials constituting the concealing layer were coated onto PET film having 100 μm thickness, and the transmitted lights of parallel lights from the spectro-photometer were measured, to determine the absorbed amounts of the light at 350 to 900 nm wavelength. A plain PET film having 100 μm thickness was used at a reference.

It is favorable that absorptivity level in visible light region is evenness. And its color is favorably white color or near white color. Then the absorptivity at 555 nm wavelength, which is the central point of whole visible lights, was measured and recorded, and at the same time, the absorptivity at laser light was measured and recorded.

Gel fraction ratio of the resin is 30% or more, favorably 50% or more, more favorably 70% or more, and 80% or more is particularly favorable. The measurement of gel fraction ratio in the present invention was conducted by providing the concealing layer with optional thickness onto the supporting member, irradiating electron beam or ultra violet light or heating to set the resin in the concealing layer, thereafter peeing off the cured layer from the supporting member and weighing the initial weight of the peeled off layer, then sandwiching the peeled off layer between 400 mesh metallic screens, then immersing them into the solvent capable of dissolving uncured resin for 24 hours, then dried them under the vacuum, and weighing the weight after dried.

Hereinafter, detailed explanations will be given regarding to the concealing material used in the present invention.

Colored materials being non-transparent for visible light but transparent for infrared light are employed au the concealing material in the present invention. It is favorable that the concealing material does not decrease the contrast of the images to be colored. Any color, as far as it makes the color image to be prominent, can be usable, but white color material is particularly favorable. As for specific examples of such color materials are instanced as titanium dioxide, zinc oxide, calcium carbonate, zinc sulfite, barium sulfate, alunima white and the likes.

With regard to the binder resin, favorable one is a resin having no absorptivity for the both band regions of visible light wavelength and infrared light wavelength. Known resins can be used as these resin, by alone or in combination. The reversible thermosensitive recording medium accroding to the present invention is significantly improved in the durability, in case of laser light is used for it, in comparison with in case of thermal head is used for it, however if the laser light is sufficiently focussed, central part of focussed area is excessively heated to much higher temperature, therefore suffering from thermal damage. Accordingly, for the purpose of improving thermal durability, it is favorable that hydroxy groups and/or carboxy groups are being introduced or made in these resin, and the resins are cross-linked using curing agent, by applying heat, ultraviolet light, or electron beam. Further, if one wants to make hardening the resin by the irradiation of ultraviolet light, light-polymerization initiator is required. In addition, it is favorable that the resin is a resin having high adhesive with both the photo-thermal conversion layer and the recording layer.

The amount ratio by weight of the colored material employed as the concealing material which are non-transparent for visible light but transparent for infrared light, and the resin favorably, ranges 95:5 to 5:95, more favorably ranges 90:10 to 10:90.

The thickness of the concealing layer (3) is favorably 0.1 μm or more. When less than 0.1 μm, satisfactory concealing effect can not attained. Further, 0.5 μm or more thickness is favorable, and 1.0 μm or more thickness is particularly favorable. The thickness of the concealing layer (3) is favorably 10 μm or less. When more than 10 μm, heat which being generated at the photo-thermal conversion layer (2), can not transmit to the recording layer (4), therefore sufficient coloring in image can not be attained. Further, 7 μm or less thickness is favorable, and 5 μm or less thickness is particularly favorable. And in the present invention, an adhesive layer may be provided between the photo-thermal conversion layer (2) and the concealing layer (3), and/or between the concealing layer (3) and the recording layer (4).

With regard to the effect of concealing, by providing the concealing layer (3), color of the photo-thermal conversion layer (2) which is placed in lower position of the concealing layer, can be suppressed. And, if laser light is fully focussed, then unnecessary elevation of the temperature is caused at the central part of the Gaussian distribution of laser beam light spot, therefore anxieties are occurred that the photo-thermal conversion layer (2) is suffered from thermal damage causing transformation, or photo-thermal conversion material in the photo-thermal conversion layer (2) is decomposed by heat, and the like problem, thus the traces caused by such damages are remained after erasing images. Thereupon, the present invention can solve these problems by the effect of the concealing layer, therefore the tolerance for repeated uses is significantly improved.

There is no special restriction in coating method of the concealing layer in the present invention, and known coating methods can be used for forming the concealing layer, including coating method such as blade coating, wire bar coating, spray coating, air knife coating, beads coating, curtain coating, gravure coating, kiss coating, reverse roll coating, dip coating, die coating and other coating method, and intaglio printing method such as print master printing, gravure printing, lithographic printing method such as offset printing, stencil printing such as mineographic printing, silk screen printing, and so forth.

The photo-thermal conversion layer has a role to absorb light and to generate heat, materials thereof are classified into inorganic material and organic material. Specific examples of inorganic material include carbon black, metallic and semi-metallic materials such as Ge, Bi, In, Te, Se, Cr and the like, and alloy thereof. These materials are formed in layer shape by vacuum deposition method or by adhering the particles material with binder resin. Specific examples of organic material include various kinds of dyes these are properly used pursuant to spectrum of light to be absorbed therein.

And, when semiconductor laser beam is applied, a near-infrared-rays-absorbing dye having absorption intensity in a range of 700 to 900 nm wavelength can be used as the photo-thermal conversion material. Specific examples of the organic photo-thermal conversion material include a cyanine dye, a quinone dye, a quinoline dye derivative of indonaphthol, a phenylenediamine nickel complex and a phthlocyanine dye. It is desirable that the photo-thermal conversion material having excellent thermal durability is selected, for applying to the repeated image forming and erasing operations many times.

Such inorganic and organic photo-thermal conversion materials are, in general, dispersed in the form of particles or molecules in the resin in the photo-thermal conversion layer. Any resin that can hold therein aforementioned particles form of photo-thermal conversion materials may be employed for the photo-thermal conversion layer, thermoplastic resin and thermosetting resin are favorably used.

Examples of thermoplastic resin include ethylene-vinylchloride copolymer resin, ethylene-vinylacetate copolymer resin, ethylene-vinylacetate-vinylchloride graft-copolymer resin, polyvinylidene chloride resin, poly-vinylchloride resin, chlorinated poly-vinylchloride resin, chlorinated polyethylene resin, chlorinated polypropylene resin, poly-vinylacetate resin, phenoxy resin, butadiene resin, fluorine resin, polyamide, polyamide-imide, polyarylate, thermoplastic polyimide, poly-etherimide, poly-ether-etherketone, polyethylene, poly-ethyleneoxide, polycarbonate, polystylene, polysulfone, poly-paramethylstylene, poly-aryamine, poly-vinyl alcohol, poly-vinylether, poly-vinylbutyral, poly-vinylfomal, polyphenylene ether, polypropylene, polymethylpentene, methacrylic resin, acrylic resin and the like resins.

Examples of thermosetting resin include epoxy resin, xylene resin, quanamine resin, diarylphthalate resin, vinylester resin, phenol resin, unsaturated polyester resin, furan resin, polyimide, polyurethane, maleic resin, melamine resin, urea resin and the like resins.

These resin may be a resin in which any aforementioned ingredients having been copolymerizated, or having been mixed.

The ratio of the inorganic and organic photo-thermal conversion materials for the binder resin is favorably in the range of 95:5 to 5:95, the range of 90:10 to 10:90 is more favorable. It is favorable that hydroxyl groups and/or carboxy groups are introduced or made in these resin, and the resins are cross-linked using curing agent, by applying heat, ultraviolet light, or electron beam. Further, if one wants to make hardening the resin by the irradiation of ultraviolet light, light-polymerization initiator is required. to be added. The thickness of the photo-thermal conversion layer is favorably 0.1 to 10 $\mu$m. If the thickness is less than 0.1 $\mu$m, enough heat generation can not attained. On the other hand if the thickness is mores than 10 $\mu$m, the diffusion of the heat generated therefrom becomes larger, hence effective utilization of the heat can not be attained. Further, 0.2 to 5 $\mu$m thickness is more favorable, and 0.3 to 3 $\mu$m thickness is particularly favorable.

Now, referring the Drawings attached, an image-recording and erasing process, and an image-recording and erasing apparatus using the reversible thermosensitive recording medium of the present invention will be explained in detail.

Figure 3:
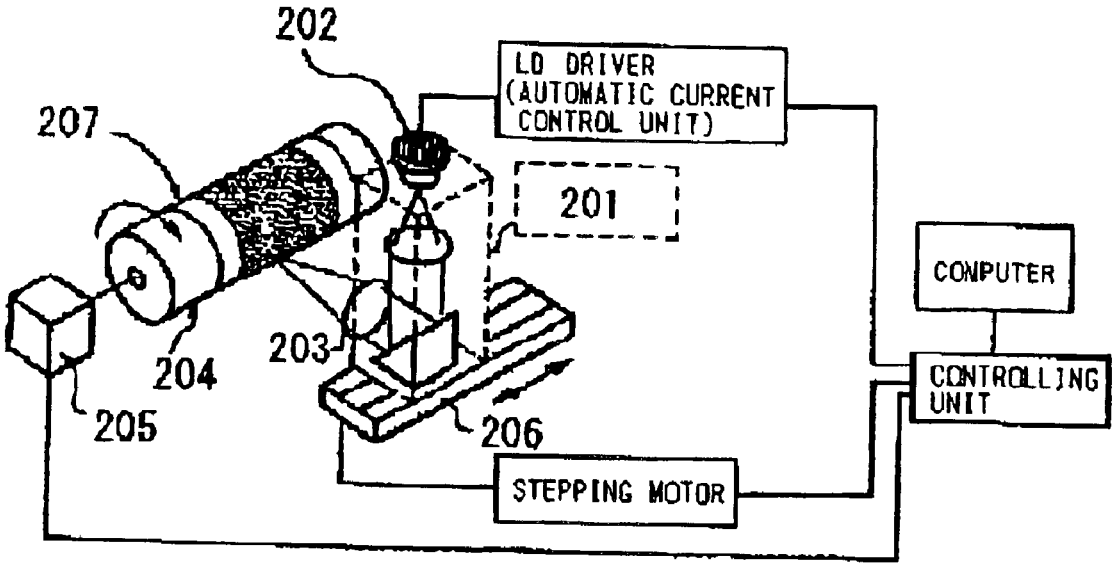
FIG. 3 is a schematic diagram showing of one example of an image recording apparatus using a laser beam for the reversible thermosensitive recording medium of the present invention.

It becomes possible to form and erase the image, using an apparatus as shown in FIG. 3, by controlling the conditions of laser beam irradiation. Namely, the whole or partial image formation and erasure can be conducted by controlling least one condition among conditions of irradiation period of the time, irradiation amount of light, focal point and intensity distribution of the light, thus adjusting the temperature to the coloring temperature and the erasing temperature, or changing the cooling velocity.

As light source, any source that irradiates a light to be absorb to the photo-thermal conversion layer for generating heat, can be used. However laser beam light is favorably used because it is easily focussed, and for examples carbon dioxide gas laser, ruby laser, argon laser, excimer laser, YAG laser, semiconductor laser can be referred, and from a point of device size, semiconductor laser beam is favorably used. Further, wavelength of the laser beam light is favorable to be 500 nm or less, or in contrast with this, to be 600 nm or more, and more favorably 700 nm or more.

The image recording apparatus as shown in FIG. 3 comprises an optical head unit (201) comprising a laser diode (202) as a light source of semiconductor laser beam and a focus lens (203) for controlling the application of the laser beam to a reversible thermosensitive recording medium (207) of the present invention; a main-scanning recording unit comprising a drum (204) and a DC motor (205) for rotating the drum (204); and a sub-scanning recording unit comprising a transportation stage (206) for transporting the optical head unit (201) in the sub-scanning direction. A heater is provided in the drum (204) of the recording apparatus, so that the drum (204) and the recording medium (207) can be preheated to a predetermined temperature.

The thermosensitive layer used in the present invention, which is "capable of changing the color tone reversibly", means a material causing a visible change reversibly pursuant to the temperature change. The visible change is classified into a color tone change and a form change such as contour change and shape change. The present invention principally uses a material causing a color tone change. The color tone change includes a transparency change, a light reflectivity change, an absorption wavelength change of light, a change of light scattering degree and so forth. And in the reversible thermosensitive recording medium for use in practice, image display is carried out by use of a combination of the aforementioned changes. To be more tangible, any reversible thermosensitive recording layers can be used as far as the transparency or color tone thereof is reversibly changed by the application of heat thereto. A specific example of such a reversible thermosensitive recording layer establishes a first colored state at a first specific temperature which is above room temperature. When this reversible thermosensitive recording layer is heated to a second temperature which is above the first specific temperature and then cooled, the reversible thermosensitive recording layer establishes a second color state. In particular, reversible thermosensitive recording medium which is capable of assuming two respective different colored states at a first specific temperature and at a second specific temperature is preferred in the present invention.

For examples, reversible thermosensitive recording media which establish a colored state at a second specific temperature and a decolorized state at a first specific temperature, such as that disclosed in Japanese Laid-open Patent Applications of Tokkai Hei 4-224996, Tokkai Hei 4-247985, Tokkai Hei 4-267190, reversible thermosensitive recording media which establishs a colored state with a color such as black, red or blue at a first specific temperature and a decolorized state at a second specific temperature, such as that disclosed in Japanese Laid-open Patent Applications of Tokkai Hei 2-188293 and Tokkai Hei 2-188294, and the like recording media, can be referred.

Out of the above mentioned reversible thermosensitive recording layers, reversible thermosensitive recording layers which are capable of reversibly assuming a colored state by the chemical changes of a dye or the like, are referred as typical reversible thermosensitive recording layers. Among these recording media, a reversible thermosensitive recording medium using a leuco dye is favorable, and a reversible thermosensitive recording medium using a leuco dye and a coloring developer having long chain alkyl group is more favorable.

As leuco dye, one or more kinds of dye precursors conventionally used in the reversible thermosensitive recording medium can be used, and such leuco dyes may be, for examples, phthalide compounds, azaphthalide compounds, fluoran compounds and the like dye precursors.

Suitable coloring developer having long chain alkyl group are, for typical examples, coloring developer compounds used in recording layer which are disclosed in Japanese Laid-open Patent Applications of Tokkai Hei 5-124360, Tokkai Hei 6-210954, Tokkai Hei 10-95175 and so forth. The coloring developer compounds used in the present invention have both of a structure capable of developing the leuco dye and a structure capable of controlling cohesion of the molecules thereof, and the both structures are being connected in the molecule. Specific examples of such structure capable of developing the leuco dye include, for examples, phenolic hydroxyl group, carboxy group, phosphate group, and other groups which can make the leuco dye colored. Specific examples of such structure capable of controlling cohesion of the molecules thereof include, for examples, long chain hydrocarbon groups. The both structures may connects through one or more divalent or more multivalent connection groups including multivalent heteroatoms, and such multivalent connection groups including multivalent heteroatoms and/or multivalent aromatic group may exist in the structure of aforementioned long chain hydrocarbon group. Examples of such coloring developers are also disclosed in Japanese Laid-open Patent Applications of Tokkai Hei 9-290563, Tokkai Hei 11-188969. They are used alone or in combination.

Various kinds of additives which are customarily employed in conventional thermosensitive recording medium may also be incorporated into the recording medium of the present invention to improve the coating properties and to upgrade the recording characteristics as necessary. Such additives may include a surfactant, an electroconductivity imparting agent, a filler, an antioxidant, a colored image stabilizer, an decolorization accelerating agent, and so forth.

The reversible thermosensitive recording layer is formed by leuco dye, coloring developer, various additives in accompany with binder resin. Any resin which can adhere these materials onto the support can be used, and known resins in the art are used alone or in combination. Resins which are curable by applying heat, ultraviolet light, electron beam, are favorably used to improve the durability for repeated uses. And particularly, resins which have reactive groups with cross-linking agent such as isocyanate compound and therefore is capable of thermosetting by the cross-linking agent. Specific examples of such resin having reactive groups include, but not restricted to, acrylic polyol resin, polyester polyol resin, polyurethane polyol resin, polyvinyl-butyral resin, celluloseacetate-propyonate, celluloseacetate-butylate and the like. Favorably, the recording layer has a gel fraction ratio of 30% or more, after it has been set. The value less than 30% reveals that it is an insufficient cross-linked state, thus causes an inferior durability. Favorably, the value of the gel fraction ratio is 50% or more, and particularly favorable is the value of 70% or more in the gel fraction ratio. The ratio of coloring ingredients and binder resin in the recording layer is favorably one part of the coloring ingredients for 1 to 10 parts of the binder resin. In case of smaller amount than that of binder resin, strength of the recording layer becomes insufficient, and larger amount than that of binder resin decreases colored density, hence causes a problem. As a method to identify that the binder resin in the present invention being cross-linked state or being non cross-linked state, the identification can be conducted by immersing the test sample tip into a solvent having high solubility. Namely, if the binder resin being non cross-linked state, the resin dissolves out to the solvent thus not remains in the test sample tip.

There is any special restriction with the cross-linking agent, but isocyanate compounds are favorably used. Specific examples of such isocyanates compounds include hexamethylene diisocyanate(HDI), tolylene diisocyanate(TDI), xylene diisocyanate(XDI), isophorone diisocyanate(IPDI), Adduct thereof with trimethylol propane and the like. Among these isocyanate compounds, hexamethylene diisocyanate(HDI) is favorable, and its adduct type compounds, burette type compounds, isocyanurate type compounds are favorably used. And, whether all added amount of the cross-linking agent having been cross-linking reacted or partially remained in non-reacted state, that either cases are allowable. Namely, the existence of non-reacted cross-linking agent is not inconvenience. This kind of reaction is progressed with the passage of time, therefore the existence of non-reacted cross-linking agent does not mean the absence of the reaction. Detected non-reacted cross-linking agent means that the reaction is in progress of cross-linking reaction. In addition, the recording layer may include a cross-linking promoter which is a catalyst useful for this kind of reaction.

The reversible thermosensitive recording layer can be formed using a coating liquid which is prepared by mixing and dispersing a mixture containing a leuco dye, a coloring developer, various kinds of additives, a binder resin and a solvent. Examples of solvent used for the preparation of the coating liquid include, but not restricted to, alcohols, ketones, ethers, glycohol ethers, esters, aromatic hydrocarbons, aliphatic hydrocarbons, and so forth solvents.

The coating liquid can be prepared using a known dispersing apparatus such as paint shakers, ball mills, attritors, three-roll mills, Keddy mills, sand mills, Dyno mills, colloid mills and the like. All materials can be dispersed in a solvent in aforementioned dispersing apparatus, or alternatively, each material is dispersed in respective solvent then obtained liquids may be mixed together. In addition, the coating liquid may be heated and then cooled to deposit one or more ingredients in the coating liquid.

There is no restriction for coating method, and the recording layer can be formed by any known coating method such as blade coating, wire bar coating, spray coating, air knife coating, beads coating, curtain coating, gravure coating, kiss coating, reverse roll coating, dip coating, die coating and the like coating.

In the recording medium of the present invention, a protective layer can be provided onto the recording layer. The protective layer may include an organic/inorganic filler, an ultraviolet light absorber, a lubricant, a colored pigment, and other additives if desired, together with an aforementioned solvent and binder resin. And the coated protective layer can be prepared using a similar dispersing apparatus and coating method as that of above mentioned dispersing apparatus and coating method.

An intermediate layer is preferably formed between the recording layer and the protective layer to improve good adhesion thereof, to prevent the recording layer from a deterionating which is caused by the coating operation of the protective layer, and to prevent a migration of the ingredients included in the protective layer to the recording layer. The intermediate layer and the protective layer preferably have relatively low oxygen transmittance to obtain good light resistance of the recorded image by preventing or reducing the leuco dye as coloring agent and coloring developer from oxidizing caused by contacting with oxygen.

The intermediate layer includes resin material as principal component, and may include filler by necessities, and may include ultraviolet ray absorber. The thickness of the intermediate layer is preferably from 0.1 to 20 $\mu$m, more preferably from 0.3 to 10 $\mu$m. The content of the filler is preferably from 1 to 93% by volume, and more preferably from 6 to 75% by volume. The intermediate layer may include an organic ultraviolet ray absorber in an amount of from 0.5 to 10 parts by weight per 100 parts by weight of the binder resin.

Solvent, dispersing apparatus for the coating liquid, coating method, drying and setting method of the coated layer, which are used for preparing the intermediate layer, can be the similar material and manner as that of aforementioned recording layer and protective layer.

The recording medium of the present invention may include an undercoat layer between the supporting member and the recording layer to improve the coloring sensitivity, and to improve adhesion thereof. As mentioned above, an intermediate layer may include between the recording layer and the protective layer to improve good adhesion thereof, to prevent the recording layer from a deterionating which is caused by the coating operation of the protective layer, and to prevent a migration of the ingredients included in the protective layer to the recording layer. These layers can include an organic/inorganic filler, an ultraviolet ray absorber, a lubricant, a colored pigment, and other additives if desired, together with an aforementioned solvent and binder resin. And these layers can be prepared using a similar dispersing apparatus and coating method as that of above mentioned dispersing apparatus and coating method.

Specific examples of the inorganic fillers include carbonates, silicates, metal oxides, metal sulfites. Specific examples of the organic fillers include, silicone resins, cellulose resins, epoxy resins, nylon resins, phenollic resins, polyurethane resins, urea resins, melamine resins, polyester resins, polycarbonate resins, styrene resins, acrylic resins, polyethylene resins, formaldehyde resins, polymethymethacrylate resin and the like resins.

Specific examples of the ultraviolet ray absorbers include compounds having salicylate structure, compounds having cyano-acylate structure, compounds having benzotriazole structure, compounds having benzophenone structure and so forth.

Figure 4:
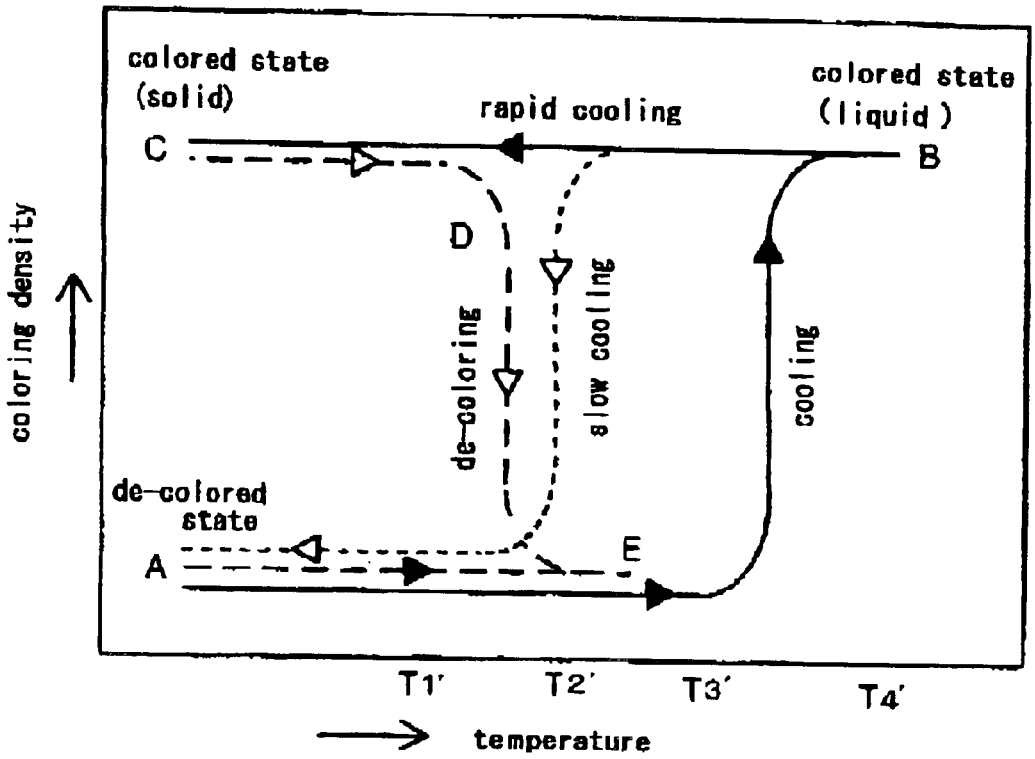
FIG. 4 is a graph showing the relationship between the colore density of a reversible thermosensitive recording medium of the present invention and the temperature thereof.

Specific examples of the lubricants include synthetic waxes, plant waxes, animal waxes, higher alcohols, higher fatty acids, higher fatty acid ˆesters, higher fatty amides and the like. However this invention is not restricted to those materials FIG. 4 is a graph illustrating the relationship between temperature of a reversible thermosensitive recording material in the present invention and image density thereof. The recording material in the reversible thermsensitive recording medium of the present invention is colored and discolored by a process shown in FIG. 4. Namely, when the recording material which is in a non-color state (A) at initial step is heated, the recording medium begins to establish coloring at an image forming temperature ($T_1$) in which the leuco dye and the coloring developer are melt and then achieves a melted colored state (B). If the recording material in this melted colored state (B) is rapidly cooled to room temperature, the solidified state of the recording material is fixed to a cooled colored state (C). Whether the recording material remains in the colored state, or the recording material returns to the non-colored state (A) (a dotted line B-A) or achieves a semi-colored state in which the image density of the recording material is relatively low compared to the image density of the recording material in the cooled state (C), it depends upon cooling speed. If the recording material in the cooled and fixed state (C) is heated again, the recording material begins to discolor at an image erasing temperature ($T_2$) lower than ($T_1$) and achieves a non-colored state (E) (a broken line C-D-E). If the recording material in the non-colored state (E) is cooled to room temperature, the recording material returns to the non-colored state (A). Thus, the recording layer can be recorded and erased the images thereof by controlling heating temperatures and cooling speeds.

The reversible thermosensitive recording medium of the present invention can be provided both of a reversible thermosensitive recording part which has visible images and an information memory part which stores invisible information, thereby can display the information being stored in the information memory part onto the reversible thermosensitive recording part, thus can confirm the information being stored in the information memory part as visible images, without any special portable device, hence improves the convenience. Such information memory part include preferably a magnetic recording layer, IC memory, photo memory and the like memory.

The reversible thermosensitive recording medium of the present invention can be processed to proper forms pursuant to the usage, for examples to card form, sheet form, roll form or other suitable forms. The recording medium processed to a card form may be used for prepaid card, point card, credit cared and the like, on the other hand, the recording medium processed to a sheet form such as a document size for example to A4 size and so forth size can be broadly used, for example, for temporary document of business use such as for a circular document and for a meeting document, by employing a printing/erasing apparatus.

Furthermore, it is also possible to apply an adhesive layer or a tackiness layer to the back surface of the supporting member opposite to the recording layer side in order to use the reversible thermosensitive recording medium as a reversible thermosensitive recording label sheet. Materials commonly used for such hesive or the tackiness layers can be used as the material for the adhesive layer or the tackiness layer. Specific examples of the the material for the adhesive layer or the tackiness layer include, but not limited to, urea resins, melamine resins, phenolic resins, epoxy resins, vinyl acetate resins, vinyl acetate-acrylic copolymer resins, ethylene-vinyl acetate copolymer resins, acrylic resins, polyvinyl ether resins, vinyl chloride-vinyl acetate copolymer resins, polystyrene resins, polyester resins, polyurethane resins, polyamide resins, chlorinated polyolefin resins, polyvinyl butyral resins, acrylate copolymer resins, methacrylate copolymer resins, natural rubbers, cyanoacrylate resins and silicone resins.

Materials of the adhesive layer or tackiness layer may be a hot melt type of material. There are both types, namely a type of release sheet, and a type of no release sheet, either the types are allowable. As described above, by providing an adhesive layer or a tackiness layer onto the recording medium of the present invention, the recording medium an be attached on the whole surface or a partial surface of a thick supporting member which is difficult to be coated with a thermosensitive layer such as thick polyvinylchloride card having a magnetic recording stripe, thereby a part of information or the like information memorized in the magnetic recording stripe can be displayed on the reversable thermosensitive recording layer, hence the recording medium is improved in convenience thereof. Of cause, such reversible thermosensitive recording medium provided with the adhesive layer or tackiness layer can be applied to, not only the polyvinylchloride card having magnetic recording stripe, but also other thick cards such as IC card, optical card and the like cards, Such reversible thermosensitive recording label sheet can also be used as a substitute, instead of an indication label sheet provided on a disc cartridge which contains a disc storing a reloadable information such as a flexible disc, a MD disc, a DVD-RAM disc and other disc, or instead of an indication label sheet provided on a memory medium for a reloadable information such as a memory card, a memory stick and a flash memory. Furthermore, in case of a disc which has no cartridge in general such as a CD-RW disc, the reversible thermosensitive recording label sheet can be attached directly onto the disc. In addition, the reversible thermosensitive recording label sheet may be used as a substitute, instead of an indication label sheet for video tape, cassette tape. The reversible thermosensitive recording label sheet is capable of changing the indication content, pursuant to the change of information stored in aforementioned memory media, hence it is applicable to a broad usage.

The reversible thermosensitive recording medium of the present invention may have a nonreversible thermosensitive layer, and in this case, color tone of each recording layer can be the same as, or different from, the color tone of another recording layer. In addition, the reversible thermosensitive recording medium of the present invention may have a colored layer having optional patterns or letters which are provided by printing process such as an offset printing, a gravure printing and the like printing process, or using an ink-jet printer, a thermal transfer printer, a thermal sublimation printer or the like printer. Furthermore, the colored layer having optional patterns or letters may have an OP vanish layer consisting mainly of a thermo-curable resin which is provided on the whole or partial area of the colored layer. And, the supporting member of the reversible thermosensitive recording medium may have a magnetic recording layer or layers which is or are positioned in the opposite side of, or/and the same side as, the reversible thermosensitive recording layer.

DETAILED DESCRIPTION OF THE PREFERRED EMBODIMENT

Having generally described this invention, further understanding can be obtained by reference to following specific examples which are provided herein for the pupose of illustration only and are not intended to be limiting. In the descriptions in the following examples, the numbers represent weight ratios unless otherwise specified.

EXAMPLE 1

As base film, a transparent polyester film with a thickness of about 100 μm "Lumirror T-60" (Trademark), made by Toray Industries, Inc.) was employed.

[Photo-thermal conversion layer]
Following components were mixed and dispersed;

| | | |
|---|---|---|
| 1) | Carbon black | 20 parts |
| 2) | Yinyl chloride-vinyl acetate-vinyl alcohol copolymer (VAGH manufactured by UCC Inc.) | 20 parts |
| 3) | Isocyanate (COLONATE L manufactured by Nippon Polyurethane Inc.) | 2 parts |
| 4) | Triethylene diamine (reagent grade purchased from Tokyo Kayaku Co., Ltd.) | 0.2 part |
| 5) | Methyl ethyl ketone | 80 parts |
| 6) | Toluene | 80 parts. |

The obtained liquid was coated onto the aforementioned base film using wire bar coater, and dried to form a photo-thermal conversion layer having about 1.0 μm thickness, held at 60° C. for 24 hours to harden the photo-thermal conversion layer.

[Concealing Layer]

An UV-curable opaque vanish ink (Dycure RT-7 manufactured by Dai-Nippon Ink Corp.) were used. The concealing layer was over-laid on the aforementioned photo-thermal conversion layer, using a printing machine, then subjected to cross-linking processing which was conducted by use of an UV ray irradiating apparatus.

The light absorptivities of concealing layer were measured, the light absorptivity at 555 nm wave length was 1.43, and the laser light absorptivity at 825 nm wave length was 0.89. The measurement of the fraction revealed a result of 70%.

[Recording Layer]

Following components were dispersed so that about 1 μm of average particle diameter was attained, using a ball mill;

| | | |
|---|---|---|
| 1) | coloring developer shown by formula 1 | 3 parts |

[formula 1]

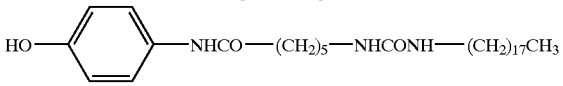

| | | |
|---|---|---|
| 2) | Dialkyl urea ("HACLEAN-SB" made by Nippon Kasei Chemical Co., Ltd.) | 1 part |
| 3) | 50% solution of acryl polyol (LR327 manufactured by Mitsubishi Rayon Inc.) | 9 parts |
| 4) | Methyl ethyl ketone | 70 parts. |

Aforementioned composition was dispersed pulverized so as to make

-continued

| | | |
|---|---|---|
| particles having the average diameter of about 1 μm. | | |
| 5) | 2-anilino-3-methyl-6-dibutylaminofluoran | 1 part |
| 6) | Isocyanate | 3 parts |

(CCOLONATE L manufactured by Nippon Polyurethane Inc.).

Then, following components were added into above dispersion containing the well dispersed coloring developer, then mixed sufficiently to prepare a coating liquid for the recording layer.

[Preparation of a Reversible Thermosensitive Medium]

The obtained coating liquid for the recording layer was coated on the concealing layer, which having been provided on the photo-thermal conversion layer formed on the polyester base film, using wire bar, then dried at 100° C. for 2 minutes, then cured 60° C. for 24 hours, to form a recording layer having about 10 g/m$^2$ thickness.

EXAMPLE 2

Concealing layer and recording layer were formed using the same transparent polyester base film and same manner as that of Example 1.

| [Photo-thermal conversion layer] Following components were mixed and dispersed; | |
|---|---|
| 1) Near injftared ray absorptive dye (PA-1006, by Mitsubishi Chemical Inc.) | 10 parts |
| 2) Vinyl chloride-vinyl acetate-vinyl alcohol copolymer (VAGH manufactured by UCC Inc.) | 30 parts |
| 3) Isocyanate (COLONATE L manufactured by Nippon Polyurethane Inc.) | 3 parts |
| 4) Triethylene diamine (reagent grade purchased from Tokyo Kayaku Co., Ltd.) | 0.2 part |
| 5) Methyl ethyl ketone | 80 parts |
| 6) Toluene | 80 parts. |

The obtained liquid was coated onto the aforementioned base film using wire bar coater, and dried to form a photo-thermal conversion layer having about 1.0 μm thickness, held at 60° C. for 24 hours to harden the photo-thermal conversion layer.

[Preparation of a Reversible Thermosensitive Medium]

Similar manner as that of Example 1 was conducted to prepare a reversible thermosensitive medium.

EXAMPLE 3

Photo-thermal conversion layer and recording layer were formed using the same transparent polyester base film and same manner as that of Example 1.

[Concealing Layer]

An UV-curable opaque vanish ink (Dycure RT-7 manufactured by Dai-Nippon Ink Corp.) was used. The concealing layer having 3.5 μm thickness was over-laid on the aforementioned photo-thermal conversion layer, using a printing machine, then subjected to cross-linking processing which was conducted by use of an UV ray irradiating apparatus.

The light absorptivities of concealing layer were measured, the light absorptivity at 555 nm wave length was 1.29, and the laser light absorptivity at 825 nm wave length was 0.80. The measurement of the fraction revealed a result of 80%.

[Preparation of a Reversible Thermosensitive Medium]

Similar manner as that of Example 1 was conducted to prepare a reversible thermosensitive medium.

EXAMPLE 4

Photo-thermal conversion layer and recording layer were formed using the same transparent polyester base film and same manner as that of Example 1.

[Concealing Layer]

An UV-curable opaque vanish ink (Dycure RT-7 manufactured by Dai-Nippon Ink Corp.) was used. The concealing layer having 4.5 μm thickness was over-laid on the aforementioned photo-thermal conversion layer, using a printing machine, then subjected to cross-linking processing which was conducted by use of an UV ray irradiating apparatus.

The light absorptivities of concealing layer were measured, the light absorptivity at 555 nm wave length was 1.57, and the laser light absorptivity at 825 nm wave length was 0.98. The measurement of the fraction revealed a result of 60%.

[Preparation of a Reversible Thermosensitive Medium]

Similar manner as that of Example 1 was conducted to prepare a reversible thermosensitive medium.

EXAMPLE 5

Photo-thermal conversion layer and recording layer were formed using the same transparent polyester base film and same manner as that of Example 1.

| [Concealing layer] | |
|---|---|
| 1) Urethane acrylate based ultraviolet-carable resin (available under trade name of Unidic C7-157 by DaiNippon Ink & Chem. Inc.) | 25 parts |
| 2) Titan dioxide (Idemitsu Titania IT-OD by Idemitsu Kosan Co. Ltd.) | 25 parts |
| 3) Butyl acetate | 75 parts. |

A liquid having above composition was coated onto the photo-thermal conversion layer which having been coated on aforementioned base film, by using a wire bar coater, and dried then subjected to cross-linking processing which was conducted by use of an UV ray irradiating apparatus, to form a concealing layer having about 4 μm thickness.

The measurement of light absorptivities of the concealing layer revealed that the light absorptivity at 555 nm wave length was 1.27, and the laser light absorptivity at 825 nm wave length was 0.95. The measurement of the fraction revealed a result of 75%.

[preparation of a Reversible Thermosensitive Medium]

Similar manner as that of Example 1 was conducted to prepare a reversible thermosensitive medium.

COMPARATIVE EXAMPLE 1

Another reversible thermosensitive recording medium was fabricated by the same manner as of Example 1, except that the concealing layer was eliminated.

COMPARATIVE EXAMPLE 2

Another reversible thermosensitive recording medium was fabricated by the same manner as of Example 2, except that the concealing layer was eliminated.

Image recordings were conducted to the reversible thermosensitive recording media obtained by aforementioned preparation processes, using a laser recording apparatus. As recording conditions, laser power was 20 mW, recording was 67 mm/sec. Solid images were printed.

Evaluations of repeated uses were conducted by records using a laser head and erasures using hot plate, this operation were repeated 1000 times and then appearances of the recording media were observed.

TABLE 1

| | contrast | durability | reflection density at background area |
|---|---|---|---|
| Ex. 1 | ○ | ○ | 0.34 |
| Ex. 2 | Δ | ○ | 0.36 |
| Ex. 3 | Δ | ○ | 0.43 |
| Ex. 4 | ○ | ○ | 0.30 |
| Ex. 5 | Δ | ○ | 0.35 |
| Com. Ex. 1 | x | x | 0.85 |
| Com. Ex. 2 | x | x | 0.63 |

<Evaluation of contrast>
○; coloring of photo-thermal conversion layer being suppressed, thus having high visibility.
Δ; slightly colored in photo-thermal conversion layer, while having high visibility.
x; colored in photo-thermal conversion layer, thereby decreasing or deteriorating in visibility.
<Evaluation of durability>
○; sufficient coloring and erasing were given even after the repeated uses.
x; insufficient coloring and erasing were given after the repeated uses.
<Evaluation results of density at background area>
Samples were placed on white color of the Gray Scale manufactured by Kodax Co., and reflex densities therof were measured using a reflective densitometer MacBeth RD-914.

From above described results it is understood that optical density of the images was significantly increased by providing the concealing layer.

Regarding to Comparative Example 1 in which a carbon black being used, therefore it was hard to recognize output image, however by Example 1 which employed the concealing layer, the color of the photo-thermal conversion layer was suppressed, therefore the visibility of output images were increased hence shown a good contrast. In Comparative Example 2, there was a color of yellowish green, thus contrast was decreased, on the other hand Example 2 was able to suppress such color by providing the concealing layer.

As for durability, when concealing layer was not provided, traces of the erased recorded image were outstanding after erasing operation, and with progressing cycle of image forming and erasing, damages by laser irradiations were accumulated, and eventually, a peeling off at intersurface between the recording layer and photo-thermal converting layer and the like inconvenience, were generated, thus by 1000 times of repeated uses, damages which were not capable of erasing were observed. On the other hand, when concealing layer was provided, traces of the erased recorded image were hardly fond out after erasing operation, thus by 1000 times of repeated uses, almost no damage was observed after erasing operation.

That means the both improvements of the contrast and durability in repeated uses can be recognized by providing the concealing layer.

As will be understood from those specific instructions, the reversible thermosensitive recording medium of the present invention is an excellent recording medium in which the color of the photo-thermal conversion layer is concealed, thereby visibility and contrast of the obtained images are significantly improved, fierier more, durability in repeated used is also significantly improved

What is claimed is:

1. A reversible thermosensitive recording medium comprising a concealing layer provided between a reversible thermosensitive recording layer, which is reversibly changed in its color by heat, and a photo-thermal conversion layer, which absorbs light with generating heat, wherein the concealing layer has an optical characteristic that the ratio of a light absorptivity of light having 555 nm wavelength, in comparison with a light absorptivity of laser light wavelength, is 80% or less.

2. A reversible thermosensitive recording medium according to claim 1, wherein the concealing layer has an optical characteristic that a light absorptivity of light having 555 nm wavelength, is 1.25 or more.

3. A reversible thermosensitive recording medium according to claim 1, wherein the concealing layer has an optical characteristic that a light absorptivity of laser light is 1 or less.

4. A reversible thermosensitive recording medium according to claim 1, wherein the optical reflection density at background area of the reversible thermosensitive recording layer is 0.5 or less.

5. A reversible thermosensitive recording medium according to claim 1, wherein the concealing layer has a gel fraction ratio of 30% or more.

6. A card having a reversible thermosensitive recording medium portion and an information memory portion, wherein the reversible thermosensitive recording medium portion is a recording medium portion according to claim 1.

7. A card having a reversible thermosensitive recording medium portion and an information memory portion, wherein the reversible thermosensitive recording medium portion is a recording medium according to claim 1, and the information memory portion comprises at least a memory selected from magnetic memory, IC memory or optical memory.

8. A card having a portion of a reversible thermosensitive recording medium layer, a supporting member and a magnetic recording layer, which are being superimposed in this order, wherein the reversible thermosensitive recording medium portion is a recording medium according to claim 1.

9. A reversible thermosensitive recording label having a reversible thermosensitive recording medium portion, a supporting member and an adhesive or stickiness layer, which are being superimposed in this order, wherein the reversible thermosensitive recording medium portion is a recording medium according to claim 1.

10. A disc cartridge having in its inside a disc which is capable of rewriting an information and has a reversible-thermosensitive recording label thereon, the reversible thermosensitive recording label has a reversible thermosensitive recording medium, a supporting member and a portion of adhesive or stickiness layer, which, are being superimposed in thus order, wherein the reversible thermosensitive recording medium is a recording medium according to claim 1.

11. A disc which is capable of rewriting an information or recording an additional information and has a reversible thermosensitive recording label thereon, wherein the reversible thermosensitive recording medium is a recording medium according to claim 1.

12. A disc which is capable of rewriting an information or recording an additional information, and has an attached reversible thermosensitive recording label thereon, wherein the reversible thermosensitive recording label has a reversible thermosensitive recording medium, a supporting member and a portion of adhesive or stickiness layer, which are being superimposed in this order, and the reversible thermosensitive recording medium is a recording medium according to claim 1.

13. A cassette for recording tape which is capable of rewriting an information and being attached with a reversible thermosensitive recording label, wherein the reversible thermosensitive recording label has a reversible thermosensitive recording medium, a supporting member and a portion of adhesive or stickiness layer, which are being superimposed in this order, and the reversible thermosensitive recording medium is a recording medium according to claim 1.

14. A reversible thermosensitive recording medium recording to claim 1, comprising image which being formed by printing.

15. An image recording and/or erasing method, where in a reversible thermosensitive recording medium according to claim 1 is used, and at least either image recording or erasing is conducted by irradiating laser light.

16. An image recording and/or erasing method, where in a reversible thermosensitive recording medium according to claim 1 is used, and at least either image recording or erasing is conducted by irradiating laser light having a wavelength 700 nm or more.

17. An image recording and erasing method, wherein reversible thermosensitive recording medium according to claim 1 is used, and both image recording and erasing are conducted, with adjusting at least any one, among applied action of light irradiation time, amount of light emission, focusing point of irradiated light, or intensity distribution of irradiated light.

18. A reversible thermosensitive recording medium according to claim 1, wherein the concealing layer includes a resin configured to bind the concealing layer to the reversible thermosensitive recording layer and the photothermal conversion layer.

19. A reversible thermosensitive recording medium according to claim 1, wherein the concealing layer includes a colored material being non-transparent for visible light but transparent for infrared light.

* * * * *